US007784614B2

(12) United States Patent
Yen

(10) Patent No.: US 7,784,614 B2
(45) Date of Patent: Aug. 31, 2010

(54) PACKAGING INSERT FOR PRODUCTS

(75) Inventor: Shu-Chun Yen, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 263 days.

(21) Appl. No.: 12/122,550

(22) Filed: May 16, 2008

(65) Prior Publication Data

US 2009/0140033 A1 Jun. 4, 2009

(30) Foreign Application Priority Data

Nov. 29, 2007 (CN) ..... 2007 1 0202757

(51) Int. Cl.
*B65D 73/00* (2006.01)
*B65D 81/02* (2006.01)
*B65D 85/38* (2006.01)

(52) U.S. Cl. ..... 206/495; 206/481; 206/583; 206/316.2

(58) Field of Classification Search ..... 206/495, 206/481, 765, 761, 756, 583, 730, 732, 735; 229/120.37
See application file for complete search history.

(56) References Cited

U.S. PATENT DOCUMENTS 955,914 A * 4/1910 Sawyer ..... 206/730
2,051,512 A * 8/1936 Bergquist ..... 206/761
2,679,930 A * 6/1954 Rossi ..... 206/481
5,967,327 A * 10/1999 Jones ..... 206/583
6,073,761 A * 6/2000 Jones ..... 206/223
6,158,589 A * 12/2000 Smith et al. ..... 206/466
2005/0252825 A1* 11/2005 Lofgren et al. ..... 206/583
2006/0138018 A1* 6/2006 McDonald et al. ..... 206/583
2007/0080095 A1* 4/2007 McDonald et al. ..... 206/583
2008/0223750 A1* 9/2008 McDonald et al. ..... 206/583

FOREIGN PATENT DOCUMENTS

CN 2341907 Y 10/1999
DE 29909647 U1 11/1999

* cited by examiner

*Primary Examiner*—J. Gregory Pickett
(74) *Attorney, Agent, or Firm*—Andrew C. Cheng

(57) ABSTRACT

An exemplary packaging insert for electronic products includes a box portion (10) and a fixing belt (20) attached to the box portion. The box portion includes a supporting plate (11) and a plurality of side flaps (12) surrounding the supporting plate. A first receiving space (13) is formed by the supporting plate of the box portion and the fixing belt. The first receiving space has an opening (21) configured for passing the electronic products therethrough. A second receiving space (14) is formed by the supporting plate and the side flaps of the box portion, configured for receiving accessories of the electronic products therein.

7 Claims, 4 Drawing Sheets

PACKAGING INSERT FOR PRODUCTS

BACKGROUND

1. Technical Field

The present invention relates to packaging inserts and, particularly, to a packaging insert of a packaging box for product for example, an electronic product, such as a digital camera.

2. Description of the Related Art

Packaging boxes are widely used for enclosing and protecting electronic products.

A typical packaging box includes an external housing and an insert. The insert has a plurality of protrusions and a plurality of recesses. The protrusions and the recesses cooperatively divide an inner space of the external housing into a plurality of receiving cavities for receiving the electronic product and its accessories therein.

However, the insert has a complicated structure, requiring a complex manufacturing process.

What is needed, therefore, is a packaging insert which has a simple structure and can be easily manufactured.

SUMMARY

In accordance with a present embodiment, a packaging insert for electronic products is provided. The packaging insert includes a box portion and a fixing belt attached to the box portion. The box portion includes a supporting plate and a plurality of side flaps surrounding the supporting plate. A first receiving space is formed by the supporting plate of the box portion and the fixing belt. The first receiving space has an opening configured for passing the electronic products therethrough. A second receiving space is formed by the supporting plate and the side flaps of the box portion, configured for receiving accessories of the electronic products therein.

Other advantages and novel features will be drawn from the following detailed description of at least one preferred embodiment, when considered in conjunction with the attached drawings.

BRIEF DESCRIPTION OF THE DRAWINGS

Many aspects of the present packaging insert can be better understood with reference to the accompanying drawings. The components in the drawings are not necessarily drawn to scale, the emphasis instead being placed upon clearly illustrating the principles of the present packaging insert. Moreover, in the drawings, like reference numerals designate corresponding parts throughout the several views.

DETAILED DESCRIPTION OF THE EMBODIMENTS

Embodiments of the present packaging insert will now be described in detail below and with reference to the drawings.

Figure 1:
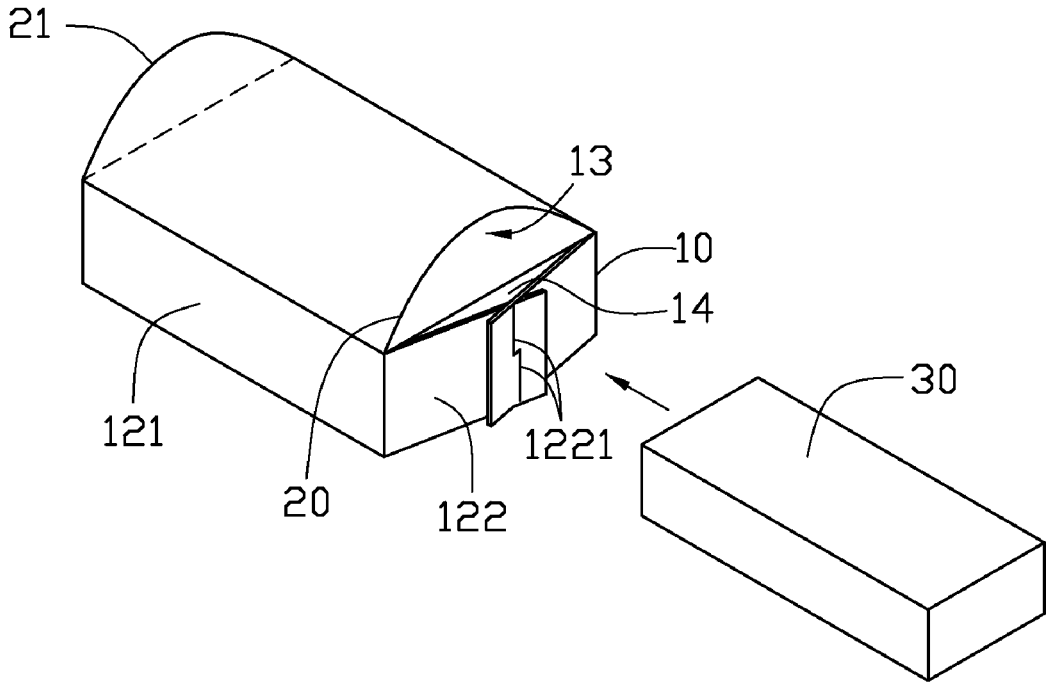
FIG. 1 is an isometric view of a packaging insert according to a present embodiment, together with an electronic product to be put into the packaging insert.
Figure 2:
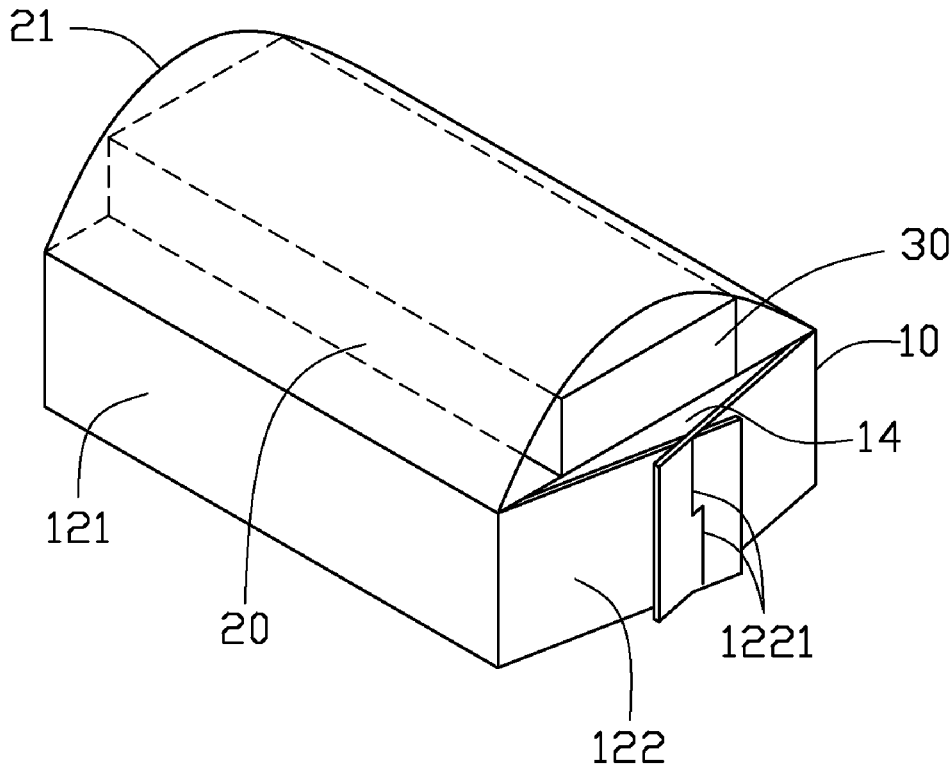
FIG. 2 is an assembled view of the packing insert and the electronic product of FIG. 1.

Referring to FIGS. 1 and 2, a packaging insert according to an embodiment of the present invention is shown. The packaging insert includes a box portion 10, and a fixing belt 20 on the box portion 10. A first receiving space 13 is formed by the box portion 10 and the fixing belt 20, for receiving an electronic product 30, such as a digital camera, therein. The first receiving space 13 has an opening 21 formed between corresponding ends of the box portion 10 and the fixing belt 20. The electronic product 30 can be put into or taken out of the first receiving space 13 through the opening 21. In this description, the electronic product 30 is provided as one example of a product that can be received in the packaging insert. Various other kinds of products and objects can instead be received in the packaging insert, as desired.

Figure 3:
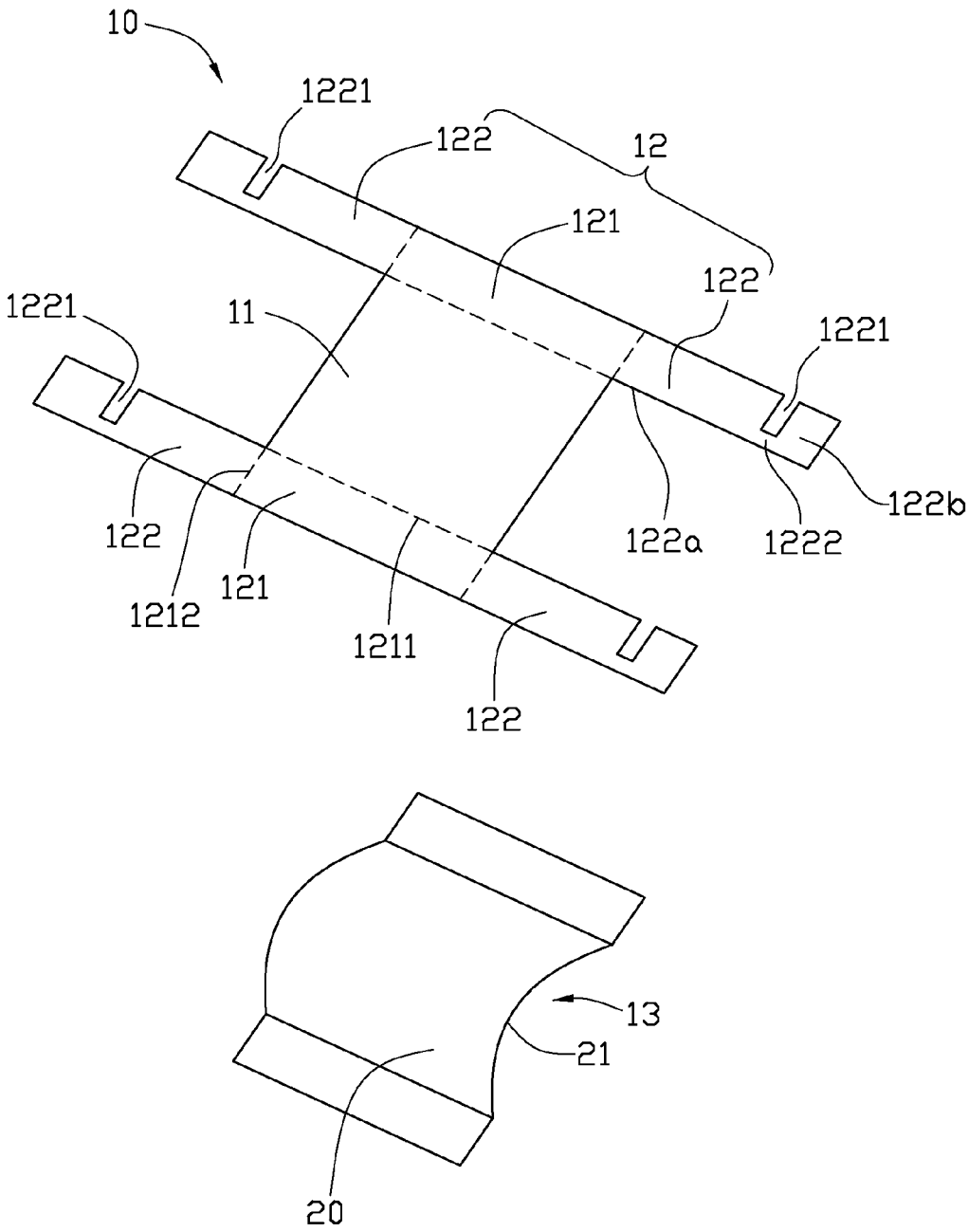
FIG. 3 is an isometric view of the packaging insert of FIG. 1 when unfolded.
Figure 4:
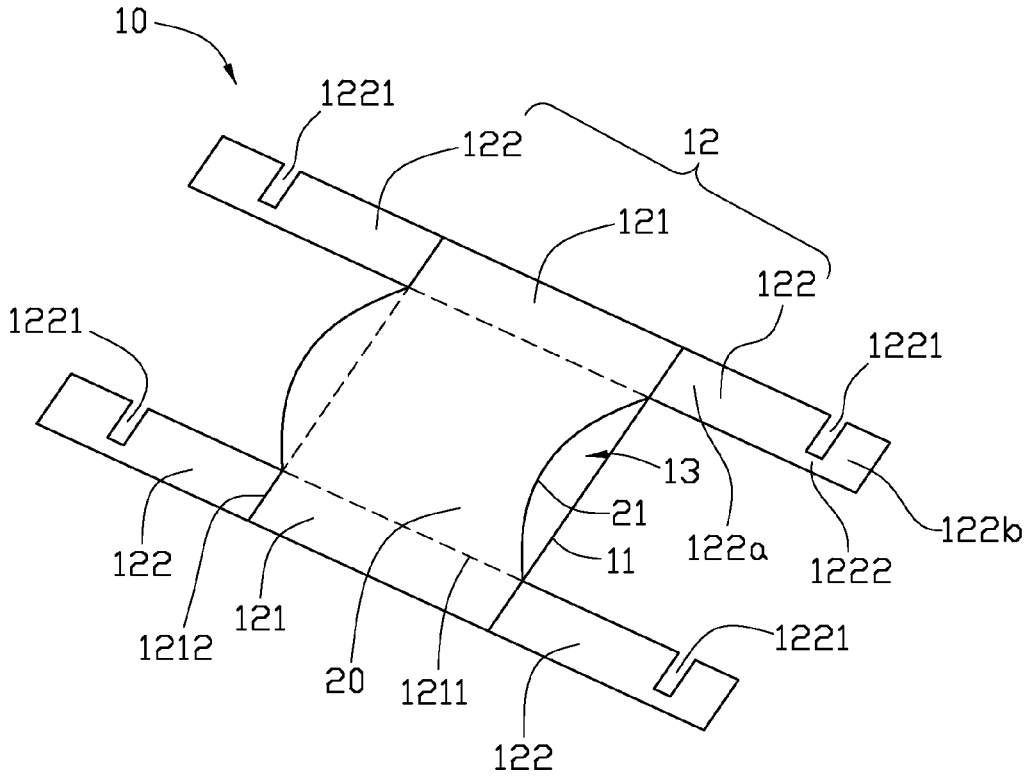
FIG. 4 is an exploded, isometric view of the packaging insert of FIG. 3.

Referring to FIGS. 3 and 4, the box portion 10 includes a supporting plate 11 and six side flaps 12, i.e., two connecting flaps 121 and four clasping flaps 122. The supporting plate 11 and the side flaps 12 are different portions of a single plate. The supporting plate 11 has a substantially rectangular configuration, and each of the side flaps 12 has an elongated and rectangular strip-like configuration. Alternatively, the supporting plate 11 and the side flaps 12 may be square in shape. The connecting flaps 121 integrally connect with two opposite sides of the supporting plate 11, respectively. Two longitudinal creases 1211 are formed between the opposite sides of the supporting plate 11 and the connecting flaps 121. Two transverse creases 1212 are formed at both ends of each connecting flap 121, each transverse crease 1212 being between the end of the connecting flap 121 and a corresponding clasping flap 122. Each of the clasping flaps 122 has a joint end 122*a* connecting with the corresponding connecting flap 121, and an engaging end 122*b* at a loose end thereof. An elongated engaging cutout 1221 is defined in the clasping flap 122 at a position adjacent to the engaging end 122*b* of each clasping flap 122. Each cutout 1221 has one side cut open. The two open sides of the cutouts 1221 on each same end of the plate 10 face in a same direction so that they can clasp together. A bridge 1222 spans across the engaging cutout 1221 and integrally connects the engaging end 122*b* with the joint end 122*a* of the clasping flap 122.

The fixing belt 20 is made of resilient material, such as a thin band of elastic plastic or cardboard. The fixing belt 20 is fixed to the connecting flaps 121 of the box portion 10 by hot press gluing or other adhesive methods. The fixing belt 20 may alternatively be fixed onto two opposite edges of the supporting plate 11 along the two longitudinal creases 1211.

Referring back to FIG. 1, in formation of the packaging insert, the connecting flaps 121 are folded down along the longitudinal creases 1211 to be perpendicular to the supporting plate 11. The clasping flaps 122 are folded along the transverse creases 1212 to be perpendicular to the connecting flaps 121. The engaging end 122*b* of one clasping flap 122 is inserted through the engaging cutout 1221 of an adjacent clasping flap 122, so that the bridge 1222 of the one clasping flap 122 is engaged in the engaging cutout 1221 of the adjacent clasping flap 122. That is, each clasping flap 122 is interlocked with an adjacent clasping flap 122, via insertion of the bridge 1222 of the clasping flap 122 into the engaging cutout 1221 of the adjacent clasping flap 122. Therefore, the clasping flaps 122 of the packaging insert are clasped together, and a second receiving space 14 is formed, opposite to the side where the first receiving space 13 is formed, by the supporting plate 11 and the side flaps 12 of the box portion 10. When the packaging insert is placed in an external housing (not shown), accessories of the electronic product 30 can be received in the second receiving space 14.

In use of the packaging insert, the electronic product 30 is put into the first receiving space 13 of the packaging insert through the opening 21. Since the fixing belt 20 is made of resilient material, the fixing belt 20 can exert a resilient force on the electronic product 30 so that the electronic product 30 can be firmly received in the first receiving space 13 of the packaging insert. Moreover, the second receiving space 14 of the box portion 10 of the packaging insert allows the box portion 10 to dampen the shock of sudden jarring impacts to the packaging insert, thereby protecting the electronic product 30 in the first receiving space 13 from being damaged.

Because the present packaging insert is essentially made from only a few components, namely, the box portion 10 and the fixing belt 20, manufacturing and assembling thereof is simple and cost-saving.

It will be understood that the above particular embodiments and methods are shown and described by way of illustration only. The principles and features of the present invention may be employed in various and numerous embodiments thereof without departing from the scope of the invention as claimed. The above-described embodiments illustrate the scope of the invention but do not restrict the scope of the invention.

What is claimed is:

1. A packaging insert comprising:

a box portion comprising a supporting plate and a plurality of side flaps surrounding the supporting plate; and a fixing belt attached to the box portion;

wherein a first receiving space is formed by the supporting plate of the box portion and the fixing belt, and the first receiving space has an opening configured for products being packed to pass therethrough;

wherein a second receiving space is formed, opposite to the side where the first receiving space is formed, by the supporting plate and the side flaps of the box portion;

wherein the supporting plate is in the shape of rectangle or square;

wherein the side flaps comprises two connecting flaps in the shape of rectangle or square and four clasping flaps in the shape of rectangle or square, each clasping flap defining one joint end on one side of the clasping flap and one engaging end on the opposite side; and wherein an engaging cutout is defined close to each engaging end of each clasping flap, a bridge spanning across the engaging cutout and integrally connecting the engaging end with the joint end of the clasping flap is also defined, the engaging cutouts being oriented in such a way that each bridge of each clasping flap is capable of being snapped in the engaging cutout of an adjacent clasping flap.

2. The packaging insert as claimed in claim 1, wherein one side of each connecting flap is connected with one of the two opposite sides of the supporting plate;

wherein the joint end of each clasping flap is connected to one connecting flap via one of the connecting flap's two opposite sides adjacent to the clasping flap;

wherein the second receiving space is formed by the supporting plate as one bottom and the two connecting flaps and four clasping flaps as peripheral walls.

3. The packaging insert as claimed in claim 2, wherein the fixing belt is fixed to the connecting flaps of the box portion by gluing means.

4. The packaging insert as claimed in claim 2, wherein the fixing belt is fixed to the two opposite edges of the supporting plate by gluing means.

5. The packaging insert as claimed in claim 1, wherein the fixing belt is made of resilient material.

6. The packaging insert as claimed in claim 1, wherein the supporting plate and the plurality of side flaps are formed on one substrate.

7. The packaging insert as claimed in claim 2, wherein the supporting plate, the two connecting flaps and the four clasping flaps are formed on one substrate.

* * * * *